US010174443B2

(12) United States Patent
Saibene et al.

(10) Patent No.: US 10,174,443 B2
(45) Date of Patent: Jan. 8, 2019

(54) PROCESS FOR IMPROVING WEAVABILITY OF A YARN

(71) Applicant: CANEPA S.P.A., San Fermo Della Battaglia (IT)

(72) Inventors: Alfonso Saibene, San Fermo Della Battaglia (IT); Carlotta Saibene, San Fermo Della Battaglia (IT)

(73) Assignee: CANEPA S.P.A., San Fermo Della Battaglia (IT)

( * ) Notice: Subject to any disclaimer, the term of this patent is extended or adjusted under 35 U.S.C. 154(b) by 0 days.

(21) Appl. No.: 14/352,674

(22) PCT Filed: Oct. 19, 2012

(86) PCT No.: PCT/IB2012/055761

§ 371 (c)(1),
(2) Date: Apr. 17, 2014

(87) PCT Pub. No.: WO2013/057723

PCT Pub. Date: Apr. 25, 2013

(65) Prior Publication Data

US 2014/0366345 A1 Dec. 18, 2014

(30) Foreign Application Priority Data

Oct. 19, 2011 (IT) ..... MI2011A1901

(51) Int. Cl.

| | |
|---|---|
| ***D02G 3/36*** | (2006.01) |
| ***D06M 15/03*** | (2006.01) |
| ***D06M 10/00*** | (2006.01) |
| ***D06M 10/10*** | (2006.01) |
| ***D06M 11/11*** | (2006.01) |
| ***D06M 11/53*** | (2006.01) |
| ***D06M 15/00*** | (2006.01) |
| ***D04B 35/24*** | (2006.01) |
| ***D06M 16/00*** | (2006.01) |

(52) U.S. Cl.

CPC ..... *D02G 3/36* (2013.01); *D04B 35/24* (2013.01); *D06M 10/001* (2013.01); *D06M 10/10* (2013.01); *D06M 11/11* (2013.01); *D06M 11/53* (2013.01); *D06M 15/03* (2013.01); *D06M 16/003* (2013.01)

(58) Field of Classification Search

CPC ..... D02G 3/36; D06M 15/03; D06M 10/001; D06M 10/10; D06M 11/11; D06M 11/53; D06M 16/003; D04B 35/24

See application file for complete search history.

(56) References Cited

U.S. PATENT DOCUMENTS

| | | | | |
|---|---|---|---|---|
| 3,441,992 | A | 5/1969 | Griffin | |
| 3,512,232 | A | 5/1970 | Bolinger | |
| 4,207,729 | A | 6/1980 | Exbrayat et al. | |
| 4,674,437 | A | 6/1987 | Griffin | |
| 4,951,366 | A * | 8/1990 | Geller | D60B 11/0096 26/28 |
| 5,501,711 | A * | 3/1996 | Weltrowski et al. | 8/543 |
| 6,197,322 | B1 | 3/2001 | Dutkiewicz et al. | |
| 2002/0016276 | A1 | 2/2002 | Spendel | |
| 2003/0134120 | A1 | 7/2003 | Kim et al. | |
| 2004/0081829 | A1 | 4/2004 | Klier et al. | |
| 2007/0020244 | A1* | 1/2007 | Aun Wan et al. | 424/93.7 |
| 2007/0031664 | A1* | 2/2007 | Kuwano et al. | 428/364 |
| 2008/0248704 | A1* | 10/2008 | Mathis | A61K 8/27 442/102 |
| 2009/0126412 | A1 | 5/2009 | Pollet et al. | |
| 2011/0256183 | A1* | 10/2011 | Frank et al. | 424/400 |
| 2017/0044711 | A1 | 2/2017 | Canepa | |

FOREIGN PATENT DOCUMENTS

| | | | |
|---|---|---|---|
| CN | 1426450 | A | 6/2003 |
| CN | 1520481 | A | 8/2004 |
| CN | 102691209 | A | 9/2012 |
| CN | 102747450 | | 10/2012 |
| CN | 105164333 | A | 12/2015 |
| CN | 106460307 | A | 2/2017 |
| DE | 19522830 | | 1/1997 |
| DE | 102005017376 | | 12/2005 |
| EP | 0209330 | | 1/1987 |
| EP | 1061162 | | 12/2000 |
| EP | 1897893 | | 3/2008 |
| EP | 1967622 | | 9/2008 |
| EP | 2 105 459 | A1 | 9/2009 |
| EP | 2554733 | A1 | 2/2013 |
| EP | 2 927 356 | A1 | 10/2015 |
| GB | 502444 | | 3/1939 |
| JP | 62057989 | A | 3/1987 |
| JP | H0241473 | | 2/1990 |
| JP | 08013341 | * | 1/1996 |
| JP | H0813341 | | 1/1996 |
| JP | 2000073280 | | 3/2000 |

(Continued)

OTHER PUBLICATIONS

Knittel et al. DE102005029107 Jan. 4, 2007 (machine translation Oct. 28, 2014).*

Derwent abstract 2007-112437 (2007).*

Derwent 2007-112437, 2007.*

Srisuk, Journal of Metals, Materials and Minerals, vol. 18, No. 2, pp. 41-45, 2008.*

Hebeish, New sizing agents and flocculants derived from chitosan, 2005.*

Alonso, Carbohydrate polymers, 77, 2009, 536-543.*

Derwent 2004-470892, 2007.*

International Search Report dated Dec. 21, 2012 for PCT/IB2012/055761 filed on Oct. 19, 2012 in the name of Saibene, Alfonso.

Written Opinion dated Dec. 21, 2012 for PCT/IB2012/055761 filed on Oct. 19, 2012 in the name of Saibene, Alfonso.

(Continued)

*Primary Examiner* — Amina S Khan

(74) *Attorney, Agent, or Firm* — Steinfl + Bruno, LLP

(57) ABSTRACT

A process for improving weavability of a yarn is described. The process has a step of application of a chitosan-containing reinforcement product and a later chitosan crosslinking step.

22 Claims, No Drawings

(56) References Cited

FOREIGN PATENT DOCUMENTS

| | | | | |
|---|---|---|---|---|
| JP | 2001-131872 | A | | 5/2001 |
| JP | 2001527162 | A | | 12/2001 |
| JP | 2004505120 | A | | 2/2004 |
| JP | 2004131647 | | | 4/2004 |
| JP | 2005155001 | A | | 6/2005 |
| JP | 2008517143 | A | | 5/2008 |
| KR | 100789462 | | * | 1/2008 |
| WO | 9932697 | | | 7/1999 |
| WO | 0049219 | | | 8/2000 |
| WO | 0209781 | A2 | | 2/2002 |
| WO | 03056081 | | | 7/2003 |
| WO | 2004/078063 | | | 9/2004 |
| WO | 2006044785 | | | 4/2006 |
| WO | 2006083710 | A2 | | 8/2006 |
| WO | 2007/083870 | A1 | | 7/2007 |
| WO | 2010/138069 | A1 | | 12/2010 |
| WO | 2013/057723 | A1 | | 4/2013 |
| WO | 2014/170876 | A1 | | 10/2014 |
| WO | 2015/087306 | A1 | | 6/2015 |
| WO | 2015/159262 | A1 | | 10/2015 |
| WO | 2016034997 | A1 | | 3/2016 |

OTHER PUBLICATIONS

International Preliminary Report on Patentability dated Jan. 31, 2014 for PCT/IB2012/055761 filed on Oct. 19, 2012 in the name of CANEPA S.P.A.

Shin, H., et al. "Effect of Ultraviolet Irradiation on Fixation of Chitosan on Cotton and Poy (Ethylene Telephtalate) Fabrics." *Sen'I Gakkaishi*, vol. 54, No. 8, XP055093810.

Italian Search Report and Written Opinion dated Feb. 16, 2012 for Italian Application MI20111901 filed on Oct. 19, 2011 in the name of Saibene, Alfonso, et al.

European Search Report dated Feb. 17, 2012 for European Application 11425217 filed on Aug. 5, 2011 in the name of Saibene, Alfonso, et al.

European Search Report and Opinion for Application No. EP 15162667.8 filed Oct. 19, 2012 on behalf of CANEPA S.P.A. Search Completed: Jul. 13, 2015, 8 pages.

Claims for Italian Patent Application No. IT MI2012A001778 A1 filed Oct. 19, 2012 on behalf of CANEPA S.P.A. (Italian original with English translation of claims), 19 pages.

International Search Report and Written Opinion for International Application No. PCT/IB2014/060834 filed Apr. 18, 2014 on behalf of Elisabetta Canepa. dated Aug. 18, 2014. 11 pages.

International Search Report for International Application No. PCT/IB2015/056588 filed Aug. 31, 2015 on behalf of CANEPA S.P.A.. dated Dec. 23, 2015. 6 pages.

International Search Report for International Application No. PCT/IB2015/052809 filed Apr. 17, 2015 on behalf of CANEPA S.P.A. dated Aug. 17, 2015. 4 pages.

Written Opinion for International Application No. PCT/IB2015/052809 filed Apr. 17, 2015 on behalf of CANEPA S.P.A. dated Aug. 17, 2015. 6 pages.

Shin et al. "Effect of Ultraviolet Irradiation on Fixation of Chitosan on Cotton and Poly(Ethylene Telephthalate) Fabrics" Sen'l Gakkaishi; vol. 54; No. 8; Jan. 1, 1998; pp. 400-406.

JPO Office Action issued for Japanese Patent Application No. 2014536400 filed on behalf of CANEPA S.P.A. dated Oct. 25, 2016. 5 pages.

SIPO Office Action issued for Chinese Patent Application No. 2012800626565 filed on behalf of CANEPA S.P.A. dated Dec. 14, 2016. 8 pages.

First Office Action for Chinese Patent Application No. 201480021688.X in the name of Elisabetta Canepa. dated Sep. 21, 2016. 15 pages. (English Translation + Chinese Original).

Second Office Action for Chinese Patent Application No. 201480021688.X in the name of Elisabetta Canepa. dated Nov. 14, 2017. 10 pages. (English Translation + Chinese Original).

First Office Action for Chinese Patent Application No. 201280062656.5 in the name of CANEPA S.P.A. dated Aug. 18, 2015. 9 pages. (English Translation + Chinese Original).

EPO Communication pursuant to Article 94(3) EPC issued for European Patent Application No. 15162667.8 filed Oct. 19, 2012 on behalf of Canepa S.p.A. dated Jul. 2, 2018. 3 pages.

JPO Office Action issued for Japanese Patent Application No. 2016-508279 filed Apr. 18, 2014 on behalf of Elisabetta Canepa. dated May 22, 2018. 6 pages. (English translation + Japanese original).

SIPO Office Action issued for Chinese Patent Application 201580022866.5 filed Apr. 17, 2015 on behalf of Canepa S.P.A. dated Jul. 4, 2018. 15 pages. (English Translation + Chinese Original).

SIPO Search Report issued for Chinese Patent Application 201580022866.5 filed Apr. 17, 2015 on behalf of Canepa S.P.A. dated Jul. 4, 2018. 4 pages. (English Translation + Chinese Original).

* cited by examiner

PROCESS FOR IMPROVING WEAVABILITY OF A YARN

CROSS REFERENCE TO RELATED APPLICATIONS

The present application is the US national stage of International Patent Application PCT/IB2012/055761 filed on Oct. 19, 2012 which, in turn, claims priority to Italian Patent Application MI2011A001901 filed on Oct. 19, 2011.

The present invention relates to a process for improving weavability of a yarn, preferably a thin yarn made from natural animal fibers, vegetable fibers, man made synthetic polymer fibers and/or man made artificial polymer fibers, used at pure state or blended together.

As used herein, the term weaving shall be intended to cover both warp-and-weft weaving and knit-weaving.

The invention also relates to a yarn, a fabric or a knit obtained through such process, as well as a process for improving affinity to finishing of a finished fabric, knit or garment, and a finished fabric, knit or garment obtained through such process.

As used herein, for example:

- a thin yarn is intended to cover yarns having a yarn count ranging from 50 to 200 Nm;
- animal fibers are intended to cover fibers obtained from insects (e.g. silkworm) or from fleece (e.g. wool, alpaca, vicuna, cashmere, etc.);
- vegetable fibers are intended to cover all the fibers obtained from plants, shrubs, inflorescences, roots, leaves such as ramie, bamboo, cotton, linen, etc.).

This yarns of the above mentioned type are known to be difficult to weave together, due to their thinness which makes them prone to breaking during weaving.

For this reason, a weaving technique is currently known, e.g. from EP1061162-B2, which comprises the steps of first doubling and twisting a natural fiber yarn with a water-soluble reinforcement yarn, typically made from PVA, then weaving the doubled and twisted yarn, and finally dissolving the water-soluble PVA yarn by immersing it in a slightly acid water solution at a temperature ranging from 85° C. to 95° C.

In the light of the above, the prior art process is easily understood to have a number of drawbacks, such as those highlighted below.

Particularly, high setts (high density coefficients in the fabric or knit) cannot be provided, because before dissolution of the water-soluble reinforcement yarn the yarn occupies as much space as a twisted yarn proper, i.e. twice the final yarn, which prevents high end-per-inch and pick-per-inch, or high density knit designs.

In addition to the above, this solution involves high consumption of water-soluble reinforcement yarn, which is a derivative of petroleum, and is entirely disposed of in wastewater.

To have an idea of the environmental impact associated with this process, 1 kg of PVA is required to process 1 kg of cashmere.

Also, considerable disposal problems arise, due to PVA solidification as the temperature of water in the desizing solution decreases.

Obviously, elimination of the water-soluble PVA reinforcement yarn requires large volumes of hot water, at a temperature ranging from 85° C. to 95° C.

In addition to this water, more water is required for the later fabric rinsing step.

Another drawback of the prior art is associated with color fastness problems, essentially caused by long-time exposure to high temperatures, i.e., 85° C.-95°, which is required to ensure full dissolution of the water soluble yarn in the water solution.

It shall be also noted that high temperature also causes felting, which involves dimensional stability problems for the yarn, the fabric obtained therewith or the garment produced.

As a result of the above, the following needs are strongly felt:

- enhancing mechanical properties, e.g. abrasion resistance, of a very thin, i.e. high-count yarn, and reducing mechanical friction between warp yarns, for trouble-free weaving;
- developing and providing an environment-friendly, low-power-consumption process for improving weavability of a thin yarn;
- developing and providing a process for improving weavability of a thin yearn, that affords high end-per-inch and pick-per-inch, or high-density knit designs;
- providing a fabric or knit made of a thin yarn, that is highly resistant to pilling, felting and rubbing, and has superior mechanical properties as well the desired softness, volume, brightness and lightness;
- providing a fabric or knit made of a thin yarn, that has improved affinity for the later finishing steps, such as dyeing or printing.

Therefore, the invention is based on the problem of conceiving and providing a process for improving weavability of a yarn, to fulfill the above needs, while obviating the above prior art drawbacks.

This problem is solved by a process for improving weavability of a yarn, particularly a thin yarn, as defined in claim 1.

In further aspects, the invention also relates to

- a process for making a fabric or a knit as defined in claim 11;
- a process for improving affinity to finishing of a finished fabric, knit or garment comprising at least one yarn, as defined in claim 17;
- a yarn as defined in claim 25;
- a fabric or knit as defined in claim 26, and
- a finished fabric, knit or garment as defined in claim 27.

According to the invention, the yarn, which is preferably a thin yarn, comprises natural animal fibers and/or vegetable fibers, and/or man made synthetic polymer fibers and/or man made artificial polymer fibers, used at pure state or blended together.

Chitosan is known to be a natural polymer derived from chitin, which is a protein contained in the exoskeleton of crustaceans.

Chitosan is a nature-renewable material and, since it is obtained from food industry by-products, it is the second most available polymer in nature, after cellulose.

A reinforcement product based on chitosan and/or derivatives thereof, used as a sizing agent, has better sizing properties than other natural substances. For instance, the addition of 5 to 15% carboxymethyl chitosan concentrations in the sizing step has provided increases in toughness of cotton fabrics by up to 55%, with 3% reduction of elongation.

Sizing solutions with high-viscosity chitosan and/or derivatives thereof allow the use thereof at low concentrations (e.g. from 0.5 to 4%) with considerable sizing agent savings.

A very small amount of desizing product is required, as the layer deposited on the fibers of each thread is very thin, with a thickness of a few microns.

Furthermore, the desizing product is fully biodegradable and may be even, theoretically, recycled.

The core of the invention consists in overcoming the technical prejudice in the field of weaving, that the chitosan polymer is conventionally used on a produced item of clothing for sanitization, but is removed after a few washes.

Unlike current teachings about the use of chitosan, the present invention provides crosslinking of chitosan and/or derivatives thereof, to increase cohesion between the fibers of yarns and/or warps, particularly of protein nature, such as cashmere, wool and silk, alpaca, camel hair, etc, even in combination with one another and/or with synthetic and/or artificial fibers.

Chitosan and/or chitosan derivative polymers, including carboxymethyl chitosan, are crosslinked, by way of example and without limitation, by UV (ultraviolet) radiation, preferably with the addition of additional chemical activators.

Crosslinking of chitosan and/or derivatives thereof has the advantage of imparting a considerable physico-mechanical resistance to the yarn.

Crosslinking of chitosan, as compared with previous uses of non-crosslinked chitosan on yarns, is highly important. The effect obtained by crosslinking of chitosan and/or derivatives thereof allows them to be applied to the yarn fibers in substantially undissolvable and durable fashion, and to also resist many repeated washes with hot soapy water.

The experimental tests conducted herein surprisingly showed that the presence of crosslinked chitosan substantially improves affinity of fibers when the latter are treated, for instance, with oxidants such as hydrogen peroxide.

The technique of crosslinking chitosan and/or its derivatives, for application to yarns made from, natural animal fibers, vegetable fibers, man made synthetic polymer fibers and/or man made artificial polymer fibers, used at pure state or blended together, is contrary to any teaching in the art of weaving, particularly weaving of valuable fabrics, as it causes an undesired structural stiffening effect on the surface of a fabric or knit, unsuitable for valuable fabrics or items of clothing.

Conversely, according to the present invention, the fibers of the treated yarns are coated with a thin layer of reinforcement product, which is first cross linked and later mostly removed in a calibrated manner, after use during yarn processing, i.e. during weaving.

The partial removal of the reinforcement product after crosslinking shall depend on secondary effect to be obtained on the item of clothing, i.e. a sanitization, antifelting effect, etc.

Furthermore, crosslinking of the reinforcement product provides the yarn, as well as the finished fabric, knit or garment comprising such yarn, with improved affinity to dyeing and printing, especially to reactive dyes reacting with —OH and —$NH_2$ groups.

In addition to the advantage provided by crosslinking of chitosan and/or derivatives thereof in processing high-count yarn, which is currently allowed by the use of water-soluble PVA yarns, an advantage is obtained in that chitosan and derivatives thereof are positively charged polycations that can break the bacterial cell membrane, having a negative potential. Antibacterial properties of chitosan are associated with the release of soluble deoxy amino sugars (due to hydrolysis) having binding properties to bacterial cells.

Obviously, this property will be only properly obtained if the reinforcement product is provided in such an amount as to at least partially remain on the fibers, indicatively an amount of at least 1% by weight, exactly as taught by the present invention.

Preferably but without limitation the process of the present invention comprises the following steps.

Chitosan and/or derivatives thereof are dissolved in a sizing solution containing, for instance, organic acids and/or mineral acids in diluted form.

The viscosity of the sizing solution is regulated by water dilution or using chitosan and/or derivatives thereof of different molecular weights. Adequate viscosities are obtained, for example, with chitosan having a molecular weight of 150,000, at a concentration of 1% by weight, in a 3.5% acetic acid aqueous solution at 35° C. (pH 2.5÷3).

Crosslinking activating agents and/or wetting surfactants may be possibly added to the sizing solution.

The yarn is impregnated by a continuous process comprising immersion in the sizing solution and its degree of squeezing is regulated by a special set of squeezing rolls.

The yarn coated with a thin layer of reinforcement product comprising chitosan and/or derivatives thereof is exposed to UV (ultraviolet) radiation for a time that will depend on the desired degree of crosslinking for chitosan and/or derivatives thereof. Exposure times will be reasonably of the order of a few minutes, which is compatible with a continuous crosslinking process.

Then the yarn will be transferred to the next processing step.

The partial removal of the reinforcement product takes place during finishing, once weaving has been completed.

Preferably, the reinforcement product is removed by a desizing process that involves hydrolysis, using oxidizing acids or enzymes. During finishing, the fabric or knit product is treated with these hydrolyzing substances, and the process is analytically controlled for a residual amount of reinforcement product to remain on the product, as needed.

Therefore, the reinforcement product is intentionally left on the fibers, stably bonded thereto to provide the above properties, and in a calibrated amount, such that the original softness of the yarns or the fabrics or knits containing such yarns will remain unaltered.

In yarn-dyed fabrics, the amount of residual crosslinked reinforcement product is minimized according to the desired degree of the sanitization and anti-felting effects.

This prerogative has a direct influence on the dimensional stability of the product, which is ensured.

In piece-dyed fabrics, the amount of residual crosslinked reinforcement product may be regulated according to the type of dye.

For example, with reactive dyes, an appropriate amount of residual reinforcement product may cause higher bath exhaustion and lower dye hydrolysis, for an improved dyeing effect and lower dye losses in wastewater.

Smaller soap amounts or densities imply smaller amounts of rinse water.

Better dyeing results are also obtained in term of full tone and bright color.

The prerogatives as described above for yarn-dyed fabrics, concerning sanitization and antifelting effects, are obviously ensured in addition.

In case of fabrics prepared for inkjet printing, screen printing or discharge and application printing the amount of residual crosslinked reinforcement product is regulated according to the relevant type of printing.

In these cases, priority is given to dimensional stability, and a thin layer of reinforcement product is left, to prevent pilling on surfaces, especially for inkjet printing treatment.

Like in piece-dyeing or yarn-dyeing, the residual crosslinked reinforcement product improved print affinity as described above and hence improves definition and tone intensity.

Furthermore, the residual crosslinked reinforcement product reduces or eliminates wetting agents and reduces or eliminates the need of using polluting chemical products in the formulation of printing inks.

Dimensional stability is also obtained by oxidation of fiber surface.

The invention will be described in greater detail below, through its aspects, and essential and/or quantitative data will be provided.

The process for improving weavability of a yarn made from natural animal fibers, vegetable fibers, man made synthetic polymer fibers and/or man made artificial polymer fibers, used at pure state or blended together, comprises the steps of:

- providing a yarn made of natural animal fibers, vegetable fibers, man made synthetic polymer fibers and/or man made artificial polymer fibers, used at pure state or blended together;
- preparing a sizing solution comprising a composition of chitosan and/or derivatives thereof as a reinforcement product;
- sizing said yarn with said sizing solution to apply said reinforcement product to the fibers of said yarn by at least partial impregnation and/or coating, to increase weavability of said yarn for later weaving as a weft and/or warp yarn or for knitting.

This process is characterized in that said sizing step is followed by crosslinking of the chitosan of said reinforcement product applied to the fibers of said yarn after sizing, such that a crosslinked reinforcement polymer is obtained from said chitosan, which is adapted to be permanently anchored to the fibers of said yarn. It shall be further noted that said thin yarn may also comprise a doubled yarn with a monofilament or multifilament yarn containing chitosan or doubled yarns with a yarn made of discontinuous fibers, containing chitosan.

After the above-mentioned sizing step, the above-mentioned step of crosslinking the chitosan of said reinforcement product applied to the fibers of said yarn is preceded by a step of drying the fibers of said yarn and the chitosan of said reinforcement product applied to the fibers of said yarn, to facilitate the later chitosan crosslinking step.

Preferably, such chitosan crosslinking step after sizing is carried out by a step of UV exposure of the chitosan applied to the yarn fibers.

Preferably, said step of sizing said yarn with said sizing solution is carried out by foularding and/or impregnation of said yarn, which is continuously fed through said sizing solution.

Preferably, such step of sizing said yarn is carried out using a sizing solution comprising

- chitosan, preferably of low molecular weight, more preferably of 150,000 Da, degree of deacetylation 75÷85%; viscosity 20÷200 cps at a concentration range of 0.5÷10% w/v, preferably 0.8÷3% w/v, more preferably 1% w/v;
- acid aqueous solution;
- radical photoinitiator.

Preferably, said acid aqueous solution comprises acetic acid at a concentration of 1.5÷3.8% v/v, preferably at a concentration of 1.8÷2.22% v/v, more preferably at a concentration of 2% v/v.

Preferably, said step of preparing a sizing solution comprises the steps of:

- dissolving chitosan, preferably of low molecular weight, more preferably 150,000 Da, in an acid aqueous solution of acetic acid,
- adding the photoinitiator in an amount of 1.4÷4% w/w based on the dry weight of chitosan, preferably 1.8÷2.2% w/w based on the dry weight of chitosan, more preferably 2% w/w based on the dry weight of chitosan, and stirring the solution, preferably by magnetic stirring.

Preferably, said step of sizing said yarn with said sizing solution is carried out with a bath ratio ranging from 1÷7 to 1÷35, preferably with a bath ratio ranging from 1÷10 to 1÷30, more preferably with a bath ratio ranging from 1÷16 to 1÷24.

According to an embodiment of the invention, the process comprises a desiring step, providing partial and calibrated removal of said crosslinked chitosan-derived reinforcement product anchored to the fibers of said yarn, from such fibers of said yarn. This will provide a yarn having remarkable sanitizing and antibacterial properties, antifelting properties and an excellent affinity to finishing treatments, such as dyeing and printing.

In a further aspect, the invention also relates to a process for making a fabric or a knit with yarns made from natural animal fibers, vegetable fibers, man made synthetic polymer fibers and/or man made artificial polymer fibers, used at pure state or blended together, comprising a step of warp-and-weft weaving of said yarns or a step of knitting of said yarns, wherein at least one or both of the warp and weft yarns, preferably the warp yarn only, used in this weaving step or a yarn used in said knitting step, is a yarn obtained by the process as described above.

Preferably, such process for making a fabric or a knit comprises a desizing step, providing partial and calibrated removal of said crosslinked chitosan-derived reinforcement product anchored to the fibers of said yarn, from such fibers of said yarn, said desizing step being carried out after said weaving step or after said knitting step.

Referring to the above mentioned desizing procedures, it shall be noted that such desizing occurs by hydrolysis, and is namely a calibrated partial desizing procedure, preferably conducted by immersion in a hydrolyzing desizing solution.

Such hydrolyzing desizing solution:

- provides enzymatic desizing, preferably using protease, amylase and/or cellulase enzymes, within the pH range, temperatures range and activities range specific to the enzyme and the relevant substrate;
- provides chemical desizing, using hydrolyzing acids, preferably hydrochloric and/or sulfhydric acid diluted to a concentration of 3÷10% v/v, more preferably 5÷7% v/v.

Preferably, this desizing step, with partial and calibrated removal of said crosslinked chitosan-derived reinforced polymer from the fibers of said yarn, leaves said crosslinked chitosan-derived reinforcement polymer on the fibers of said yarn subjected to said sizing step, in an amount of 0.4÷9% w/w based on the dry weight of the yarn after said sizing step.

The process for improving weavability of a yarn as described above provides a yarn made from natural animal fibers, vegetable fibers, man made synthetic polymer fibers and/or man made artificial polymer fibers, used at pure state or blended together, comprising a coated/impregnated sizing agent consisting of a crosslinked chitosan-derived reinforcement polymer.

Furthermore, the process for making a fabric or knit as described above provides a fabric or a knit comprising at least one yarn as described above, wherein said fabric or said knit comprise said crosslinked chitosan-derived reinforcement polymer on the fibers of said at least one yarn subjected to said sizing step, in an amount of 0.4÷9% w/w based on the dry weight of the yarn after said sizing step.

In another aspect, the invention relates to a process for improving affinity to finishing of a finished fabric, knit or garment, comprising at least one yarn made from natural animal fibers, vegetable fibers, man made synthetic polymer fibers and/or man made artificial polymer fibers, used at pure state or blended together. This process comprises the steps of:

providing a finished fabric, knit or garment comprising at least one yarn made of natural animal fibers, vegetable fibers, man made synthetic polymer fibers and/or man made artificial polymer fibers, used at pure state or blended together;

preparing a sizing solution comprising a composition of chitosan and/or derivatives thereof;

sizing said finished fabric, knit or garment with said sizing solution to apply said chitosan composition to the fibers of said at least one yarn by at least partial impregnation and/or coating;

after said sizing step, crosslinking the chitosan of said chitosan composition to obtain a crosslinked polymer from said chitosan, which is permanently anchored to the fibers of said at least one yarn, and after said step of crosslinking the chitosan of said chitosan composition, proceeding to a desizing step with partial and calibrated removal of said crosslinked chitosan-derived polymer from the fibers of said at least one yarn.

Preferably, after the above-mentioned sizing step, said step of crosslinking the chitosan of said chitosan composition applied to the fibers of said yarn is preceded by a step of drying the fibers of said yarn and the chitosan of said reinforcement product applied to the fibers of said finished fabric, knit or garment, to facilitate the later chitosan crosslinking step.

Preferably, said chitosan crosslinking step is carried out by a step of UV exposure of said finished fabric, knit or garment.

Preferably, said step of sizing said finished fabric, knit or garment is carried out by foularding and/or impregnation of said finished fabric, knit or garment in said sizing solution.

Preferably, such sizing step is carried out using a sizing solution comprising:

chitosan, preferably of low molecular weight, preferably of 150,000 Da, degree of deacetylation 75÷85%; viscosity 20÷200 cps at a concentration range of 0.5÷10% w/v, preferably 0.8÷3% w/v, more preferably 1% w/v;

acid aqueous solution;

radical photoinitiator.

Preferably, said acid aqueous solution comprises acetic acid at a concentration of 1.5÷3.8% v/v, preferably at a concentration of 1.8÷2.22% v/v, more preferably at a concentration of 2% v/v.

Preferably, said step of preparing a sizing solution comprises the steps of:

dissolving the chitosan of low molecular weight in an acid aqueous solution of acetic acid, adding the photoinitiator in an amount of 1.4÷4% w/w based on the dry weight of chitosan, preferably 1.8÷2.2% w/w based on the dry weight of chitosan, more preferably 2% w/w based on the dry weight of chitosan, and stirring the solution, preferably by magnetic stirring.

Preferably, said step of sizing said finished fabric, knit or garment with said sizing solution is carried out with a bath ratio ranging from 1÷7 to 1÷35, preferably with a bath ratio ranging from 1÷10 to 1÷30, more preferably with a bath ratio ranging from 1÷16 to 1÷24.

Therefore, the process for improving the affinity to finishing of a finished fabric, knit or garment comprising at least one yarn can provide a finished fabric, knit or garment comprising said crosslinked chitosan-derived reinforcement polymer on the fibers of said at least one yarn subjected to said sizing step, in an amount of 0.4÷9% w/w based on the dry weight of the yarn after said sizing step.

Oxidative treatment of keratin protein fibers generates anionic groups (cysteic acid residues) and removes surface lipids from fibers, thereby enhancing affinity of chitosan and its derivatives to the fibers.

The above disclosure is susceptible to a number of changes and variants within the inventive concept, as outlined by the annexed claims.

Thus, for example, the yarn, which is preferably a thin yarn, may also comprise a doubled yarn with a monofilament or multifilament yarn containing chitosan or be doubled with a yarn made of discontinuous fibers, containing chitosan.

The invention claimed is:

1. A process for improving weavability of a yarn made from natural animal fibers, vegetable fibers, man made synthetic polymer fibers and/or man made artificial polymer fibers, used in a pure state or blended together, consisting of the steps of:

providing a yarn made of natural animal fibers, vegetable fibers, man made synthetic polymer fibers and/or man made artificial polymer fibers, used in a pure state or blended together, wherein the yarn does not contain cellulose;

preparing a sizing solution containing a composition of chitosan and/or derivatives thereof as a reinforcement product, wherein the chitosan and/or derivatives thereof have a molecular weight of 150,000 Da; and sizing said yarn with said sizing solution to apply said reinforcement product to the fibers of said yarn by at least partial impregnation and/or coating, to increase weavability of said yarn for later weaving as a weft and/or warp yarn or for knitting, crosslinking the chitosan of said reinforcement product applied to the fibers of said yarn after sizing, such that a crosslinked reinforcement polymer is obtained from said chitosan, wherein the chitosan is adapted to be permanently anchored to the fibers of said yarn, and desizing said yarn by providing partial and calibrated removal of said crosslinked chitosan-derived reinforcement product anchored to the fibers of said yarn, from such fibers of said yarn, wherein the desizing step is performed by immersion in a hydrolyzing enzymatic desizing solution containing protease, amylase and/or cellulase enzymes, and optionally, after the sizing said yarn and before crosslinking the chitosan, drying the fibers of said yarn and the chitosan of said reinforcement product applied to the fibers of said yarn to facilitate the later chitosan crosslinking step.

2. The process for improving weavability of a yarn as claimed in claim 1, wherein said yarn contains a doubled yarn with a monofilament or multifilament yarn containing chitosan or doubled yarns with a yarn made of discontinuous fibers, containing chitosan.

3. The process for improving weavability of a yarn as claimed in claim 1, wherein the step of drying is present.

4. The process for improving weavability of a yarn as claimed in claim 1, wherein said step of crosslinking the chitosan applied to the fibers of said yarn after sizing is carried out by a step of UV exposure of said chitosan applied to the fibers of said yarn.

5. The process for improving weavability of a yarn as claimed in claim 1, wherein the sizing said yarn is carried out using the sizing solution containing:

chitosan having degree of deacetylation 75÷85%; viscosity 20÷200 cps at a concentration range of 0.5÷10% w/v, 0.8÷3% w/v, or 1% w/v;

an acid aqueous solution; and a radical photoinitiator.

6. The process for improving weavability of a yarn as claimed in claim 1, wherein said step of sizing said yarn with said sizing solution is carried out with a bath ratio ranging from 1÷7 to 1÷35, with a bath ratio ranging from 1÷10 to 1÷30, or with a bath ratio ranging from 1÷16 to 1÷24.

7. The process for improving weavability of a yarn as claimed in claim 1, wherein the yarn is made of natural animal fiber.

8. The process for improving weavability of a yarn as claimed in claim 7, wherein the natural animal fiber is selected from one of cashmere, wool and silk, alpaca, and camel hair or combination thereof.

9. A process for making a fabric or a knit with a yarn made from natural animal fibers, vegetable fibers, man made synthetic polymer fibers and/or man made artificial polymer fibers, used in a pure state or blended together consisting of the steps of:

providing a yarn made of natural animal fibers, vegetable fibers, man made synthetic polymer fibers and/or man made artificial polymer fibers, used in a pure state or blended together, wherein the yarn does not contain cellulose;

preparing a sizing solution containing a composition of chitosan and/or derivatives thereof as a reinforcement product, wherein the chitosan and/or derivatives thereof have a molecular weight of 150,000 Da; and sizing said yarn with said sizing solution to apply said reinforcement product to the fibers of said yarn by at least partial impregnation and/or coating, to increase weavability of said yarn for later weaving as a weft and/or warp yarn or for knitting, crosslinking said chitosan of said reinforcement product applied to the fibers of said yarn, such that a crosslinked reinforcement polymer is obtained from said chitosan, wherein the chitosan is adapted to be permanently anchored to the fibers of said yarn, warp-and-weft weaving or knitting said yarn to obtain a fabric or a knit, and desizing said yarn by providing partial and calibrated removal of said crosslinked chitosan-derived reinforcement product anchored to the fibers of said yarn, from such fibers of said yarn, wherein the desizing step is performed by immersion in a hydrolyzing enzymatic desizing solution containing protease, amylase and/or cellulase enzymes, optionally, after the sizing said yarn and before crosslinking the chitosan, drying the fibers of said yarn and the chitosan of said reinforcement product applied to the fibers of said yarn to facilitate the later chitosan crosslinking step.

10. The process as claimed in claim 9, wherein said yarn contains a doubled yarn with a monofilament or multifilament yarn containing chitosan or doubled yarns with a yarn made of discontinuous fibers, containing chitosan.

11. The process as claimed in claim 9, wherein the step of drying is present.

12. The process as claimed in claim 9, wherein said step of crosslinking the chitosan applied to the fibers of said yarn after sizing is carried out by a step of UV exposure of said chitosan applied to the fibers of said yarn.

13. The process as claimed in claim 9, wherein the sizing solution contains:

chitosan having degree of deacetylation 75÷85%; viscosity 20÷200 cps at a concentration range of 0.5÷10% w/v, 0.8÷3% w/v, or 1% w/v;

an acid aqueous solution; and a radical photoinitiator.

14. The process as claimed in claim 9, wherein said step of sizing said yarn with said sizing solution is carried out with a bath ratio ranging from 1÷7 to 1÷35, with a bath ratio ranging from 1÷10 to 1÷30, or with a bath ratio ranging from 1÷16 to 1÷24.

15. The process as claimed in claim 9, wherein said partial and calibrated desizing step is carried out by immersion in a hydrolyzing desizing solution.

16. The process as claimed in claim 15, wherein said hydrolyzing desizing solution:

provides enzymatic desizing, preferably using protease, amylase and/or cellulase enzymes, or provides chemical desizing, using hydrolyzing acids, hydrochloric and/or sulfhydric acid diluted to a concentration of 3÷10% v/v, or 5÷7% v/v.

17. The process as claimed in claim 9, wherein said desizing leaves said crosslinked chitosan-derived reinforcement polymer on the fibers of said yarn subjected to said sizing step, in an amount of 0.4÷9% w/w based on the dry weight of the yarn after said sizing step.

18. A process for improving affinity to finishing of a finished fabric, knit or garment, containing at least one yarn made from natural animal fibers, vegetable fibers, man made synthetic polymer fibers and/or man made artificial polymer fibers, used in a pure state or blended together, consisting of the steps of:

providing a finished fabric, knit or garment containing at least one yarn made of natural animal fibers, vegetable fibers, man made synthetic polymer fibers and/or man made artificial polymer fibers, used in a pure state or blended together, wherein the yarn does not contain cellulose;

preparing a sizing solution containing a composition of chitosan and/or derivatives thereof, wherein the chitosan and/or derivatives thereof have a molecular weight of 150,000 Da;

sizing said finished fabric, knit or garment with said sizing solution to apply said chitosan composition to the fibers of said at least one yarn by at least partial impregnation and/or coating;

crosslinking the chitosan of said chitosan composition to obtain a crosslinked polymer from said chitosan, wherein the chitosan is permanently anchored to the fibers of said at least one yarn, and desizing said yarn by providing partial and calibrated removal of said crosslinked chitosan-derived polymer from the fibers of said at least one yarn, wherein the desizing step is performed by immersion in a hydrolyzing enzymatic desizing solution containing protease, amylase and/or cellulase enzymes; and optionally, after the sizing said yarn and before crosslinking the chitosan, drying the fibers of said at least one yarn and the chitosan of said chitosan composition applied to the fibers of said finished fabric, knit or garment, to facilitate the later chitosan crosslinking step.

19. The process for improving affinity to finishing of a finished fabric, knit or garment as claimed in claim 18, wherein the step of drying is present.

20. The process for improving affinity to finishing of a finished fabric, knit or garment as claimed in claim 18, wherein said chitosan crosslinking step is carried out by a step of UV exposure of said finished fabric, knit or garment and the fibers of said at least one yarn.

21. The process for improving affinity to finishing of a finished fabric, knit or garment as claimed in claim 18, wherein in said sizing step the sizing solution contains:

chitosan having degree of deacetylation 75÷85%; viscosity 20÷200 cps at a concentration range of 0.5÷10% w/v, 0.8÷3% w/v, or 1% w/v;

an acid aqueous solution; and a radical photoinitiator.

22. The process for improving affinity to finishing of a finished fabric, knit or garment as claimed in claim 18, wherein said step of sizing said finished fabric, knit or garment with said sizing solution is carried out with a bath ratio ranging from 1÷7 to 1÷35, with a bath ratio ranging from 1÷10 to 1÷30, or with a bath ratio ranging from 1÷16 to 1÷24.

* * * * *